US006648699B1

(12) United States Patent
Makino et al.

(10) Patent No.: US 6,648,699 B1
(45) Date of Patent: Nov. 18, 2003

(54) CONNECTOR

(75) Inventors: Hirotaka Makino, Yokkaichi (JP); Hajime Okada, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/358,158

(22) Filed: Jul. 20, 1999

(30) Foreign Application Priority Data

Jul. 21, 1998 (JP) ..... 10-205036

(51) Int. Cl.[7] ..... H01R 13/514
(52) U.S. Cl. ..... 439/752; 439/733.1; 439/595
(58) Field of Search ..... 439/752, 733.1, 439/595

(56) References Cited

U.S. PATENT DOCUMENTS 5,252,096 A 10/1993 Okada
5,437,565 A * 8/1995 Atsumi et al. ..... 439/752
5,474,477 A 12/1995 Aoyama
5,516,308 A 5/1996 Yamanashi
5,653,613 A * 8/1997 Shimoda ..... 439/752
5,848,919 A * 12/1998 Nagano ..... 439/752
5,997,364 A * 12/1999 Matsuoka et al. ..... 439/752
6,010,374 A * 1/2000 Miwa ..... 439/752
6,036,552 A * 3/2000 Atsumi ..... 439/752

FOREIGN PATENT DOCUMENTS

EP 0 723 312 A 7/1996
EP 0 817 322 A 1/1998

* cited by examiner

*Primary Examiner*—P. Austin Bradley
*Assistant Examiner*—Edwin A. León
(74) *Attorney, Agent, or Firm*—Gerald E. Hespos; Anthony J. Casella

(57) ABSTRACT

A connector has a retainer 13 which is insertable through one side surface of a housing 11. The retainer is provided with forked locking arms. The width and/or thickness of partial locking arms 13*a* is set smaller than the full locking arms 13*b* to thereby set the elastic forces of the partial locking arms 13*a* smaller than those of the full locking arms 13*b*.

13 Claims, 5 Drawing Sheets

CONNECTOR

BACKGROUND OF THE INVENTION

1. Field of the Invention

The present invention relates to a connector and is particularly designed to improve operability and functionability when a retainer for locking terminal fitting(s) is held in its partial locking position and full locking position.

2. Description of the Related Art

A prior art connector provided with a retainer is shown in FIG. 6. The prior art connector includes a housing 1 with a cavity 1*a*. A terminal fitting 2 is inserted into the cavity 1*a* from the rear end portion of the housing 1. A retainer 3 is inserted through one side surface of the housing 1 to prevent the terminal fitting 2 from moving in its withdrawing direction. Partial and full locking arms 3*a* and 3*b* project from the retainer 3 to define a fork shape, and locking projections 3*c*, 3*d* project outwardly from the leading ends of the partial and full locking arms 3*a*, 3*b* respectively. Locking projections 3*c* and 3*d* can be engaged with locking steps 1*c*, 1*d* formed on inner walls of a retainer insertion portion 1*b*. Thus the retainer 3 can be held in two positions: a partial locking position 4 and a full locking position 5 (position in phantom line in FIG. 7).

In the partial locking position 4 where the retainer 3 is not yet fully inserted, the retainer 3 does not interfere the insertion of the terminal fitting 2 into the cavity 1*a* as indicated in solid line in FIG. 6. On the other hand, in the full locking position 5 where the retainer 3 is fully inserted, a part of the retainer 3 is engaged with the terminal fitting 2 to prevent the movement of the terminal fitting 2 in its withdrawing direction as indicated in phantom line in FIG. 6. During the insertion of the retainer 3 to the partial locking position 4, the partial locking arm 3*a* is deflected inwardly when the locking projection 3*c* moves over the partial locking step 1*c*, with the result that the retainer 3 reaches the partial locking position 4. Here, the retainer 3 is positioned by the contact of the locking projection 3*d* of the full locking arm 3*b* with the lower surface of the full locking step 1*d*. Similarly, the retainer 3 reaches the full locking position 5 after the full locking arm 3*b* is deflected inwardly.

In inserting the retainer 3, it is desirable to push the retainer 3 with a small force before reaching the partial locking position 4 and to stably hold the retainer 3 in the partial locking position thereafter. This is because the retainer 3 may be pushed straight to the full locking position 5 if an attempt is made to insert the retainer 3 to the partial locking position 4 with a strong force. In this case, the retainer 3 needs to be pulled back using a jig or like device, requiring extra time and labor. On the other hand, an external matter may strike against the retainer 3 during transportation or the like after the retainer 3 has reached the partial locking position 4 and before the terminal fittings 2 are inserted.

Thus, it is an object of the present invention to provide a connector having an improved operability.

SUMMARY OF THE INVENTION

According to the invention, there is provided a connector, comprising a housing with one or more cavities for at least partly accommodating at least one terminal fitting to be inserted through a rear end portion of the housing. The connector further comprises a retainer which is partly insertable into the cavities through a retainer insertion portion. The retainer can be held in a partial locking position where the retainer permits the insertion and withdrawal of the at least one terminal fitting, and in a full locking position where the retainer substantially engages the inserted at least one terminal fitting to prevent the movement thereof in a withdrawing direction. One or more partial locking arms and one or more full locking arms project from the retainer, and locking steps for the partial and full locking arms are formed on inner walls of the retainer insertion portion to hold the retainer in the partial locking position and in the full locking position, respectively. The width and/or thickness of the partial locking arms are set smaller than those of the full locking arms to thereby set the elastic forces of the partial locking arms smaller than those of the full locking arms.

Accordingly, the retainer is pushed to the partial locking position with a smaller force, whereas it is pushed from the partial locking position to the full locking position with a larger force. This prevents the retainer from inadvertently being pushed straight to the full locking position when being pushed to the partial locking position. Simultaneously, the retainer also may be prevented from inadvertently falling while being in the partial locking position, before the terminal fittings are inserted. When the retainer is pushed to the full locking position, an operator preferably can properly feel the retainer having reached the full locking position and the retainer can stably keep locking the terminal fittings in its full locking position. Thus, operability during the insertion of the retainer and a function of locking the terminal fittings can be improved.

According to a preferred embodiment, a pair of partial and full locking arms project from each of the substantially opposite sides of the retainer. Thus the retainer can be securely positioned in its partial and full lock positions.

Preferably, the one or more partial locking arms and the one or more full locking arms are fork-shaped and are arranged along forward and backward directions of the retainer.

Further preferably, the locking steps engage one or more partial locking projections and one or more full locking projections that project preferably outward from the partial and full locking arms, respectively, to hold the retainer in the partial locking position and in the full locking position, respectively. Thus the locking arms have a simple but effective construction.

Most preferably, the one or more partial locking projections are engageable with the corresponding locking steps after the partial locking arms are deflected preferably inwardly, and when the retainer is pushed to the partial locking position. The one or more full locking projections are engageable with the corresponding locking steps after the full locking arms are deflected, preferably inwardly, and when the retainer is pushed from the partial locking position to the full locking position.

According to a further preferred embodiment, there is provided a connector, comprising a housing provided with cavities for accommodating at least one terminal fitting to be inserted through a rear end of the housing. The connector further comprises a retainer which is partly insertable into cavities through a retainer insertion portion, which is open in one side surface of the housing. The retainer can be held in a partial locking position where the retainer permits the insertion and withdrawal of the at least one terminal fitting and in a full locking position where the retainer engages the inserted at least one terminal fitting to prevent the movement thereof in a withdrawing direction. A pair of partial and full locking arms which are fork-shaped and arranged along forward and backward directions project from each of the opposite sides of the retainer. Locking steps are formed on inner walls of the retainer insertion portion for engaging partial and full locking projections projecting outwardly from the partial and full locking arms to hold the retainer in the partial locking position and in the full locking position, respectively. The partial locking arms deflect inwardly and partial locking projections engage with the corresponding locking steps when the retainer is pushed to the partial locking position. Similarly the full locking arms deflect inwardly and the full locking projections engage with the locking steps when the retainer is pushed from the partial locking position to the full locking position. The width and/or thickness of the partial locking arms are set smaller than those of the full locking arms, and thereby set the elastic forces of the partial locking arms smaller than those of the full locking arms.

With this construction, the retainer can be inserted to the partial locking position with a small force since the elastic forces of the partial locking arms are set smaller than those of the full locking arms. Accordingly, there is no likelihood that the retainer is pushed straight to the full locking position. On the other hand, the larger elastic forces of the full locking arms prevent the retainer held in the partial locking position from inadvertently moving to the full-locking position by an external impact. Further, an operator can strongly feel the movement of the full locking projections over the locking steps when the retainer is pushed from the partial locking position to the full locking position and can notice that the retainer has reached the full locking position.

Preferably, the lengths of the partial and full locking arms are set substantially equal to each other. The elastic forces of the partial and full locking arms can be differed according to the application even if the lengths thereof are equal to each other. The height of the retainer can be set lower if the partial and full locking arms have the same length, and hence the connector can be smaller.

Further preferably, the retainer insertion portion is substantially open in one side surface of the housing.

Most preferably, the full locking projection of the full locking arm, is substantially in contact with a receiving surface of the corresponding locking step when the retainer is arranged in the partial locking position. Accordingly, a loose movement of the retainer in its partial lock position can be prevented.

These and other objects, features and advantages of the present invention will become more apparent upon a reading of the following detailed description and accompanying drawings.

DETAILED DESCRIPTION OF THE PREFERRED EMBODIMENT

Figure 1:
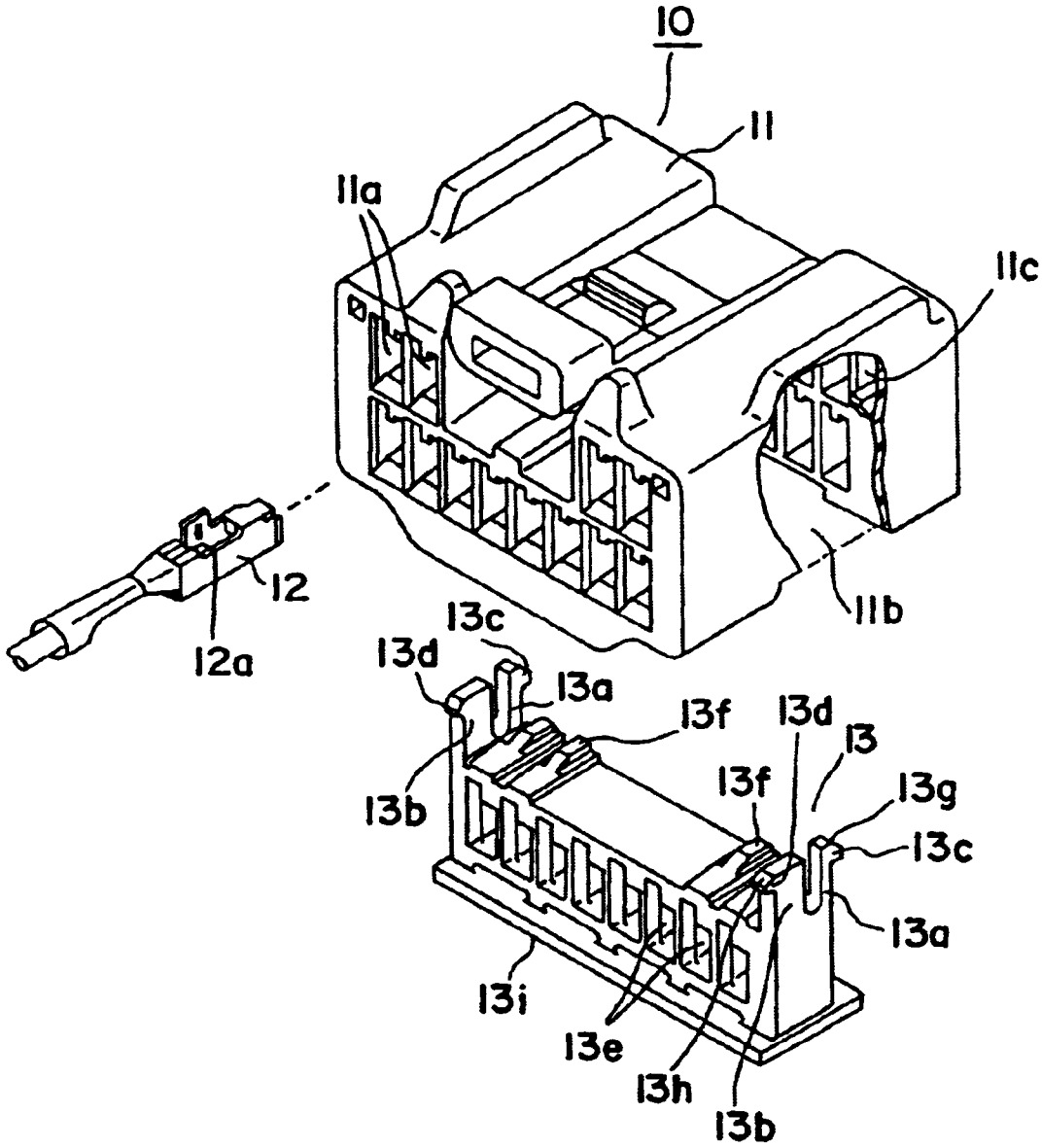
FIG. 1 is an exploded perspective view of a connector according to one embodiment of the present invention.

A connector according to the invention is identified by the numeral 10 in FIGS. 1–5. The connector 10 is comprised of a housing 11 made e.g. of synthetic resin and a retainer 13 to be mounted in the housing 11. The housing 11 is provided with a plurality of cavities 11 a arranged substantially side by side e.g. in two stages for at least partially accommodating terminal fittings 12 to be inserted preferably from a rear portion of the housing 11. The housing 11 also is formed with a substantially rectangular retainer insertion portion 11*b*. The retainer insertion portion 11*b* is a recess which is open in one side surface of the housing 11 substantially along the entire transverse direction thereof and extends inwardly.

The retainer 13 has substantially rectangular parallelepipedic lattice-like shape so as to be fitted into the retainer insertion portion 11*b* and is provided with holding portions 13*e* which extend along forward and backward directions. The holding portions communicate with the cavities 11*a* when being mounted in the retainer insertion portion 11*b*. A terminal locking projection 13*f* is engageable with a stepped portion 12*a* of the corresponding terminal fitting 12 and projects from each holding portion 13*e*.

A pair of flexible fork-shaped partial and full locking arms 13*a*, 13*b* are arranged along forward and backward directions and project at the opposite sides of the retainer 13. Partial and full locking projections 13*c*, 13*d* project outwardly from the leading ends of the partial and full locking arms 13*a*, 13*b*, respectively, and slanted guide surfaces 13*g*, 13*h* are formed at the leading ends of the partial and full locking projections 13*c*, 13*d*, respectively.

Figure 2:
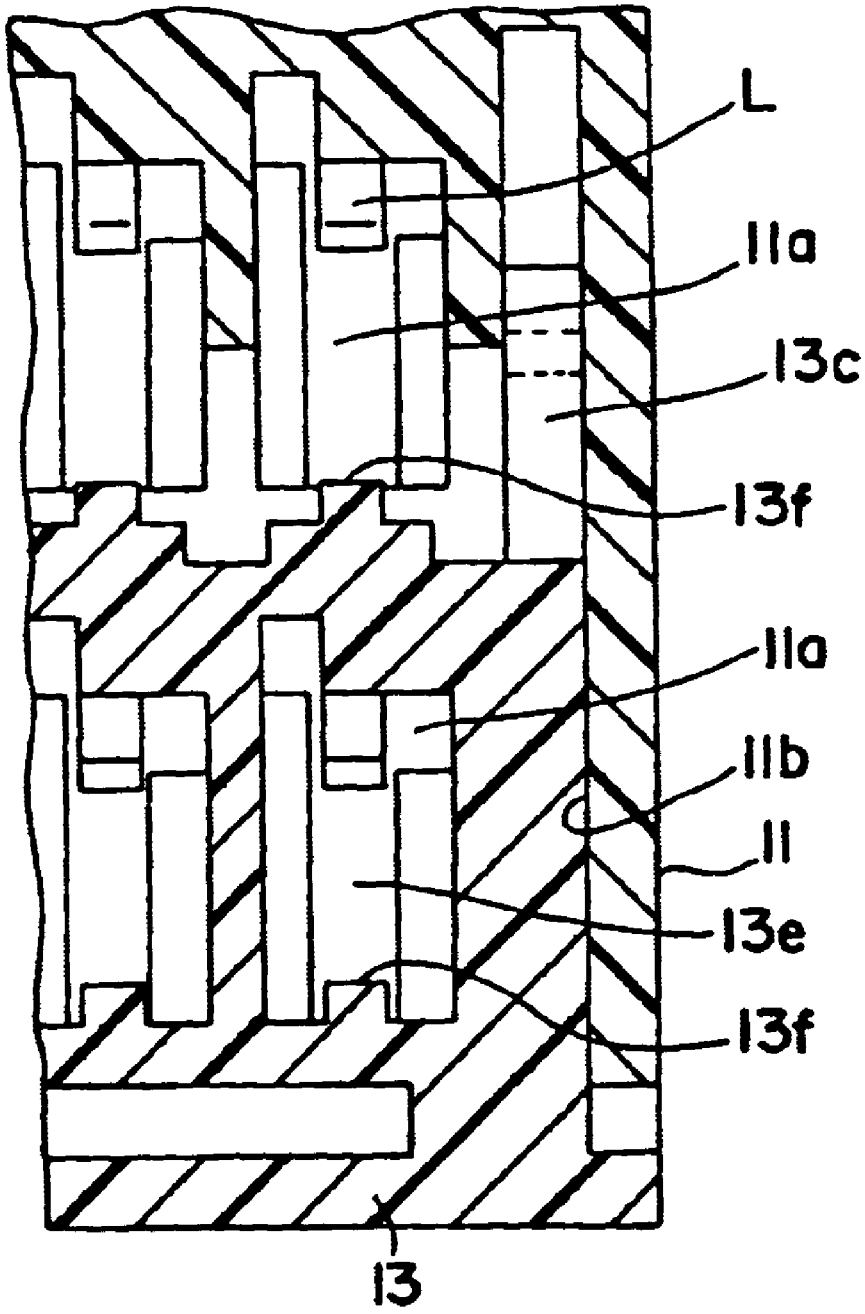
FIG. 2 is a section of the connector when a retainer is inserted.
Figure 3A:
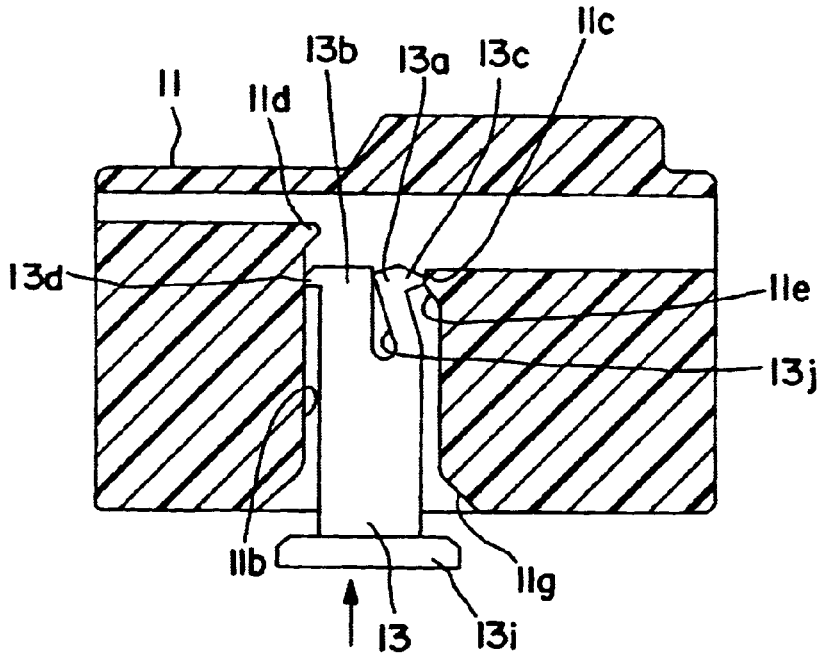
FIGS. 3(A) and 3(B) are sections showing a state where the retainer is located before a partial locking position and a state where the retainer is located in the partial locking position.
Figure 3B:
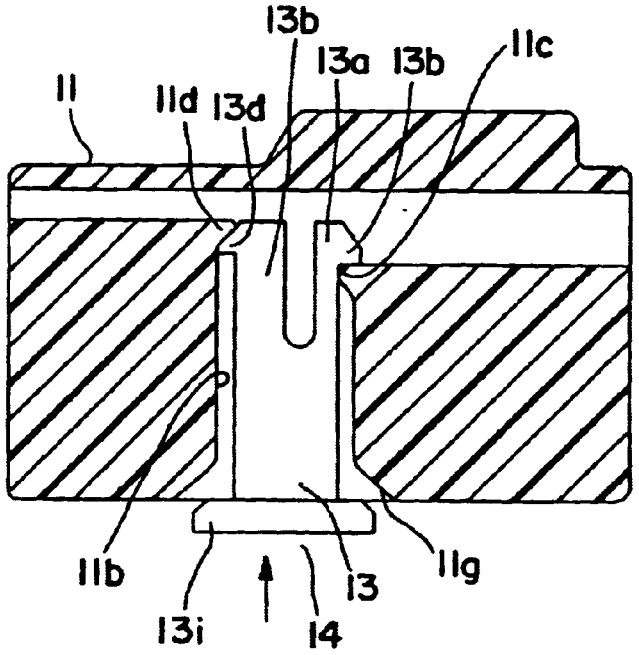
Figure 4A:
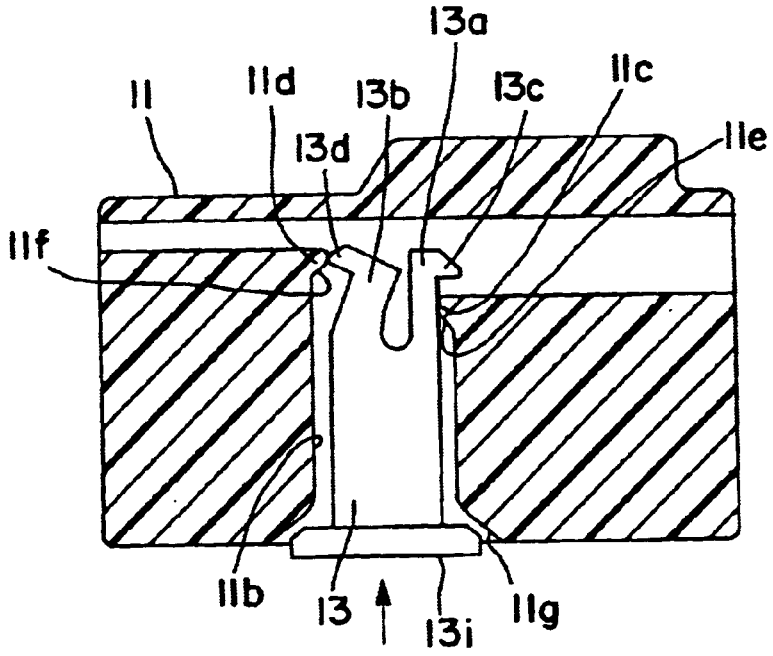
FIGS. 4(A) and 4(B) are sections showing a state where the retainer is located before a full locking position and a state where the retainer is located in the full locking position.
Figure 4B:
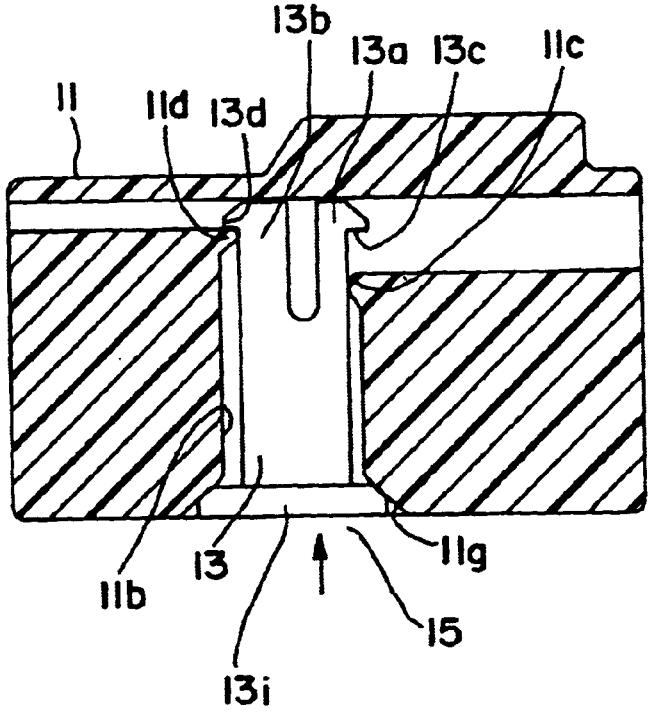

On the other hand, locking steps 11*c*, 11*d* project from inner walls of the retainer insertion portion 11*b* of the housing 11, and are engageable with the partial and full locking projections 13*c*, 13*d*. Slanted guide receiving surfaces 11*e*, 11*f*, that are similar to the guide surfaces 13*g*, 13*h* of the partial and full locking projections 13*c*, 13*d*, are formed on the inner wall surfaces to be opposed to the guide surfaces 13*g*, 13*h*. As shown in FIGS. 3(A) and 3(B), the locking steps 11*c*, 11*d* project in vertically different positions or in positions spaced along the insertion direction ID of he retainer into the retainer insertion portion 11*b*. When the retainer 13 is inserted to an intermediate position in the retainer insertion portion 11*b*, the partial locking projections 13*c* move over the locking steps 11*c* and, at substantially the same time, the full locking projections 13*d* come into contact with the other locking steps 11*d*. This state is referred to as a partial locking position 14. On the other hand, as shown in FIGS. 4(A) and 4(B), when the retainer 13 is further inserted, the full locking projections 13*d* move over the locking steps 11*d* and, at the substantially same time, a lid 13*i* of the retainer 13 preferably comes substantially into contact with an inlet surface 11*g* of the retainer insertion portion 11*b*. This state is referred to as a full locking position 15. As shown in FIG. 2, the partial locking position 14 of the retainer 13 is a position where the terminal locking projections 13*f* are retracted substantially from the cavities 11 a so as not to interfere the insertion and withdrawal of the terminal fittings 12. The full locking position 15 is such a position where the terminal locking projections 13*f* substantially engage with the stepped portions 12*a* of the inserted terminal fittings 12 to prevent the terminal fittings 12 from moving in their withdrawing direction.

Figure 5:
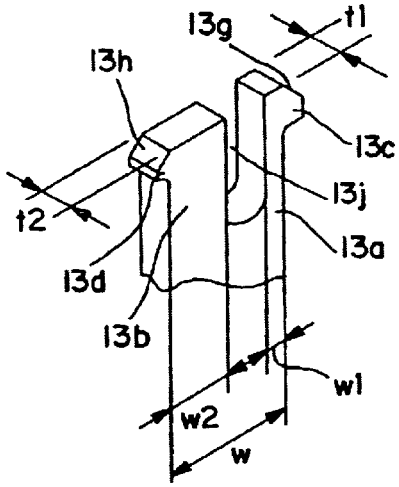
FIG. 5 is an enlarged perspective view showing an essential portion of the retainer.

A clearance 13*j* between the partial and full locking arms 13*a* and 13*b* of the retainer 13 has a width necessary for the partial locking arm 13*a* or the full locking arm 13*b* to be deflected inwardly when the retainer 13 reaches the partial locking position 14 or the full locking position 15. The widths of the partial and full locking arms 13*a*, 13*b* are differed without widening width W of the entire retainer 13 while ensuring the above width of the clearance 13. In other words, width W1 of the partial locking arm 13*a* preferably is set smaller than width W2 of the full locking arm 13*b* by locating the clearance 13*j* toward the partial locking arm 13*a*, thereby setting the elastic force of the partial locking arm 13*a* smaller and that of the full locking arm 13*b* larger. To provide this difference in the elastic force, thickness t1 of the partial locking arm 13*a* may be set smaller than thickness t2 of the full locking arm 13*b* as shown in FIG. 5.

The retainer 13, dimensioned as above, is mounted in the housing 11, by inserting the locking arms 13*a*, 13*b* of the retainer 13 into the retainer insertion portion 11*b*, and pushing the lid 13*i*. The partial locking arms 13*a* deflect inwardly and the partial locking projections 13*c* of the partial locking arms 13*a* move over the locking steps 11*c* of the retainer insertion portion 11*b*. Thus the retainer 13 reaches the partial locking position 14. The partial locking arms 13*a* can be engaged with the locking steps 11*c* by a small pushing force because they are narrower and have a smaller elastic force. In the partial locking position 14 of FIG. 3(B), the full locking projections 13*d* are held in contact with the full locking steps 11*d* before moving over them. Further, since the full locking arms 13*b* are wider and have a stronger force, the retainer 13 is prevented from being pushed straight to the full locking position 15 during insertion to the partial locking position 14.

Figure 6:
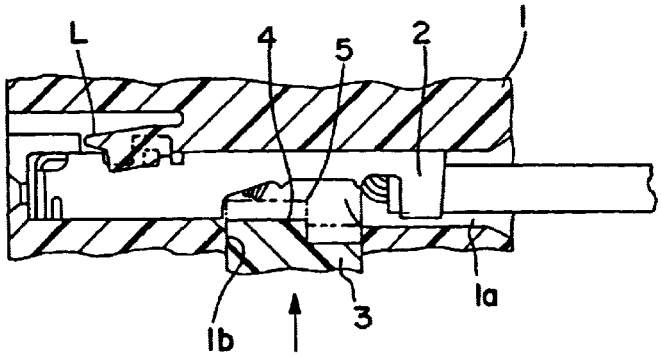
FIG. 6 PRIOR ART
FIG. 6 is a section showing an essential portion of a prior art connector.
Figure 7:
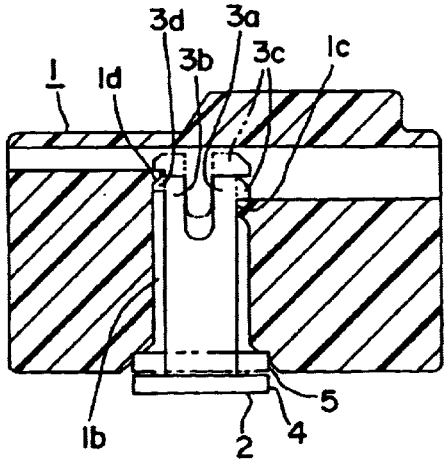
FIG. 7 PRIOR ART
FIG. 7 is a section of the prior art connector.

Subsequently, the terminal fittings 12 are inserted through the rear portion of the housing 11 with the retainer 13 in its partial locking position 14 and are locked in the cavities 11 a by locking portions L (as in the prior art of FIG. 6). If the retainer 13 in its partial locking position 14 is pushed strongly as shown in FIG. 4(A) after the insertion of all terminal fittings 12 is completed, the full locking arms 13*b* deflect inwardly and the full locking projections 13*d* move over the locking steps 11*d*. Then, as shown in FIG. 4(B), the retainer 13 reaches the full locking position 15. Substantially simultaneously, the lid 13*i* contacts with the inlet surface 11*g* of the retainer insertion portion 11*b* and becomes flush with the side surface of the housing 11 to close the opening formed by the retainer insertion portion 11*b*. The retainer 13 is pushed to the full locking position 15 with a stronger force as compared with the force used to push it to the partial locking position 14. Accordingly, an operator can sufficiently feel the movement of the full locking projections 13*d* over the locking steps 11*d* due to inertial forces acting during this time and notice that the retainer 13 has reached the full locking position 15 by a clicking sound given out when the lid 13*i* comes into contact with the inlet surface 11*g* of the retainer insertion portion 11*b*. In the full locking position 15, the terminal fittings 12 are locked so as not to come out of the cavities 11 a by the engagement of the terminal locking projections 13*f* and the stepped portions 12*a*. This state is stably maintained by the enlarged elastic forces of the full locking arms 13*b*.

As is clear from the above description, the retainer is pushed to the partial locking position with a smaller force, whereas it is pushed from the partial locking position to the full locking position with a larger force. This prevents the retainer from being pushed inadvertently straight to the full locking position when being pushed to the partial locking position. Simultaneously, the retainer may also be prevented from inadvertently falling while being in the partial locking position, before the terminal fittings are inserted. When the retainer is pushed to the full locking position, an operator can feel that the retainer has reached the full locking position and the retainer can stably keep locking the terminal fittings in its full locking position. Thus, operability during the insertion of the retainer and a function of locking the terminal fittings can be improved.

What is claimed is:

1. A connector, comprising:

a housing with at least one cavity for at least partly accommodating at least one terminal fitting to be inserted through a rear end portion of the housing, and a retainer insertion portion extending into the housing along an insertion direction and communicating with the cavity, partial and full locking steps disposed in the insertion portion, the partial and full locking steps each having a deflection generating surface aligned at an acute angle to the insertion direction, a locking surface aligned normal to the insertion direction and spaced from the deflection generating surface by a distance along the insertion direction no greater than an extent of the deflection generating surface along the inserting direction, a retainer which is partly insertable into the cavities through the retainer insertion portion, the retainer being movable selectively between a partial locking position where the retainer permits the insertion and withdrawal of the terminal fiting, and a full locking position where the retainer substantially engages the terminal fitting inserted in the cavity to prevent the movement thereof in a withdrawing direction, at least one partial locking arm and at least one full locking arm being formed on the retainer, the partial and full locking arms being of substantially equal lengths and being spaced from one another by a clearance that is substantially free of structural restraints such that each said locking arm can deflect through the clearance toward the other of the locking arms, partial and full locking projections projecting transversely from the partial and full locking arms respectively and extending a distance along the respective locking arm no less than the distance between the respective partial and full locking steps, and wherein at least one of the width and thickness of the partial locking arms is set smaller than that of the full locking arms to thereby set the elastic forces of the partial locking arms smaller than those of the full locking arms, and wherein the partial locking arm returns resiliently to an undeflected condition after moving beyond the deflection generating surface a distance no greater than the extent of the deflection generating surface for quickly and easily achieving partial locking and preventing unintended insertion to a full locking position.

2. A connector according to claim 1, wherein a pair of partial and full locking arms project from each of substantially opposite sides of the retainer.

3. A connector according to claim 1, wherein the partial locking arm and the full locking arm define a fork-shape and are arranged along forward and backward directions of the retainer.

4. A connector according to claim 1, wherein the retainer insertion portion is substantially open in one side surface of the housing.

5. A connector according to claim 1, wherein the partial and full locking arms have end surfaces facing away from the locking surfaces of the housing when the retainer is in the full locking position, the partial and full locking arm having lengths such that the end surfaces thereof substantially contact an opposing surface of the housing when the retainer is in the full locking position for preventing tilting of the retainer in the retainer insertion portion.

6. A connector according to claim 1, wherein full locking arms are at least twice as wide as the partial locking arms as measured in a direction of deflection of the respective arms.

7. A connector, comprising:

a housing with at least one cavity for at least partly accommodating at least one terminal fitting to be inserted through a rear end portion of the housing, and a retainer insertion portion extending into the housing and communicating with the cavity, an inlet surface formed on the housing and substantially surrounding the retainer insertion portion;

a retainer which is partly insertable into the cavities through the retainer insertion portion, the retainer being movable selectively between a partial locking position where the retainer permits the insertion and withdrawal of the terminal fitting, and a full locking position where the retainer substantially engages the terminal fitting inserted in the cavity to prevent the movement thereof in a withdrawing direction, the retainer having a lid configured and disposed to be spaced externally from the housing when the retainer is in the partial locking position and being substantially flush with an outer surface of the housing when the retainer is in the full locking position, the lid having a continuous inwardly-facing peripheral surface disposed, dimensioned and aligned for surface contact with the inlet surface of the retainer insertion portion when the retainer is moved to the full locking position and for providing a clicking sound indicative of the retainer reaching the full locking position;

at least one partial locking arm and at least one full locking arm being formed on the retainer, the partial and full locking arms being of substantially equal lengths and being spaced from one another by a clearance that is substantially free of structural restrains such that each said locking arm can deflect through the clearance toward the other of the locking arms, and locking steps being formed on inner walls of the retainer insertion portion for the partial and full locking arms to hold the retainer in the partial locking position and in the full locking position, respectively; and wherein at least one of the width and thickness of the partial locking arms is set smaller than that of the full locking arms to thereby set the elastic forces of the partial locking arms smaller than those of the full locking arms.

8. A connector according to claim 7, wherein the inlet surface of the housing is chamfered inwardly, and wherein the peripheral surface of the lid of the retainer is chamfered to mate with the inlet surface on the housing when the retainer is in the full locking position for achieving a high surface contact area and a correspondingly high clicking sound.

9. A connector according to claim 8, wherein the partial and full locking arms have end surfaces facing away from the locking surfaces of the housing when the retainer is in the full locking position, the partial and full locking arm having lengths such that the end surfaces thereof substantially contact an opposing surface of the housing when the retainer is in the full locking position for preventing tilting of the retainer in the retainer insertion portion.

10. A connector according to claim 9, wherein full locking arms are at least twice as wide as the partial locking arms as measured in a direction of deflection of the respective arms.

11. A connector according to claim 7, wherein the locking steps engage at least one partial locking projection and at least one full locking projection that project outward from the partial and full locking arms, respectively, to hold the retainer in the partial locking position and in the full locking position, respectively.

12. A connector according to claim 11, wherein the partial locking projection is engageable with the corresponding locking step after the partial locking arm is deflected during insertion of the retainer to the partial locking position, and the full locking projection is engageable with the corresponding locking step after the full locking arm is deflected during insertion of the retainer from the partial locking position to the full locking position.

13. A connector according to claim 11, wherein the full locking projection is substantially in contact with a receiving surface of the corresponding locking step when the retainer is in the partial locking position.

* * * * *